US012765690B2

(12) United States Patent
Armatys et al.

(10) Patent No.: US 12,765,690 B2
(45) Date of Patent: Oct. 20, 2026

(54) POCKETED SPRINGS ASSEMBLY, MATTRESS AND POCKETED SPRINGS ASSEMBLY MANUFACTURING METHOD

(71) Applicant: Sleep Brands Limited, London (GB)

(72) Inventors: Patryk Armatys, Grabow nad Prosna (PL); Adam Wirt, Nowe (PL)

(73) Assignee: SLEEP BRANDS LIMITED, London (GB)

( * ) Notice: Subject to any disclaimer, the term of this patent is extended or adjusted under 35 U.S.C. 154(b) by 79 days.

(21) Appl. No.: 18/903,842

(22) Filed: Oct. 1, 2024

(65) Prior Publication Data

US 2025/0107632 A1 Apr. 3, 2025

(30) Foreign Application Priority Data

Oct. 2, 2023 (PL) ..... 446290

(51) Int. Cl.
*A47C 27/07* (2006.01)
*A47C 27/06* (2006.01)

(52) U.S. Cl.
CPC ..... *A47C 27/07* (2013.01); *A47C 27/062* (2013.01); *A47C 27/064* (2013.01); *A47C 27/066* (2013.01)

(58) Field of Classification Search
CPC ..... A47C 27/07; A47C 27/062; A47C 27/064; A47C 27/066
See application file for complete search history.

(56) References Cited

U.S. PATENT DOCUMENTS

| | | | | |
|---|---|---|---|---|
| 1,683,684 | A * | 9/1928 | Macinerney | A47C 27/04 5/655.8 |
| 6,202,238 | B1 * | 3/2001 | Mossbeck | A47C 27/066 5/717 |
| 6,256,820 | B1 * | 7/2001 | Moser | A47C 27/064 5/721 |
| 7,013,515 | B1 * | 3/2006 | Price | A47C 27/05 5/721 |
| 10,165,867 | B2 * | 1/2019 | Mossbeck | A47C 27/066 |
| 12,122,663 | B2 * | 10/2024 | Tan | B68G 7/12 |
| 2003/0177585 | A1 * | 9/2003 | Gladney | A47C 27/14 5/717 |
| 2015/0359350 | A1 * | 12/2015 | Eigenmann | A47C 27/05 5/655.8 |

FOREIGN PATENT DOCUMENTS

| | | | |
|---|---|---|---|
| DE | 4031654 | A1 | 4/1992 |
| WO | 2018/224139 | A1 | 12/2018 |

* cited by examiner

*Primary Examiner* — Eric J Kurilla
(74) *Attorney, Agent, or Firm* — Merchant & Gould P.C.

(57) ABSTRACT

A pocket spring assembly 1 has a core 1' of a pocket spring assembly formed by a plurality of first, adjacent and interconnected pocket spring webs 2 and at least one second pocket spring web 4 connected to the core. Additional strips are provided connecting the at least one pocket spring web 2 with the first and second layers of textile material, respectively, provided on the core 1'. A mattress has a pocket spring assembly and a method is for manufacturing such an assembly.

10 Claims, 9 Drawing Sheets

POCKETED SPRINGS ASSEMBLY, MATTRESS AND POCKETED SPRINGS ASSEMBLY MANUFACTURING METHOD

The object of the invention is a pocket spring assembly having at least one stiffened edge of the assembly. The invention also relates to a mattress comprising such an assembly, as well as to a method of manufacturing of the pocket spring assembly.

The present invention belongs to the field of mattresses comprising a pocket spring assembly. Such pocket spring assemblies, also referred to in the industry as innersprings, are formed by a plurality of coil springs which are enclosed in pockets of textile material, each spring being placed in an individual pocket, the adjacent pockets forming pocket springs strings, also referred to as pocket springs webs, the said pocket springs webs being connected side to side to form a pocket spring assembly which can serve as a mattress layer in a mattress.

One of the important technical problems in the design of pocket spring assemblies is to ensure that the edges of such assemblies are stiffened. A number of solutions can be found in the state of the art, which are based on a suitable adjustment of the parameters of the spring elements at the edge of the assembly, e.g. through a suitable selection of the wire thickness or the number of spring coils or the hardness of the foam from which the blocks constituting the spring element in the assembly of pocket spring elements are made. One known solution is also to pack the springs more densely in the edge area of the mattress layer, as for example disclosed in publication DE 40 31 654 A1.

In another solution, the springs to form a stiffened border are placed in the intermediate space created between two springs of an adjacent row of pocket springs.

Still another approach is proposed in publication WO2018/224139A1, which discloses a method of manufacturing a pocket spring assembly having an edge with springs having different stiffness characteristics compared to the springs of the core of the assembly. The disclosed method comprises the step of providing a core (body) of the pocket spring assembly comprising a plurality of first webs (or strings) of pocket springs, followed by the step of attaching at least one second web of pocket springs to a lateral surface of said core of the pocket spring assembly, so that at least one second web of pocket springs extends (runs) in the longitudinal direction of the core of the pocket spring assembly. The springs of at least one second web of pocket springs have spring characteristics or spring geometry different from the springs in the first webs forming the core of the pocket spring assembly. At least one second pocket springs web, when connected, forms a pocket spring assembly together with the core. In order to stiffen the longitudinal edges of the assembly, the step of providing the aforementioned core additionally comprises terminating the core at both longitudinal ends with pocket spring webs in which springs with different spring characteristics or geometries are provided compared to the springs contained in the pockets of the first pocket spring webs, forming the core of the pocket spring assembly. This provides stability at the longitudinal ends of the assembly. In an advantageous embodiment of such a pocket spring assembly, the method also comprises attaching at least one second pocket spring web to both the first lateral surface and the second lateral surface of the core of the pocket spring assembly, which, in combination with the stiffening provided by said pocket spring strings provided at the longitudinal ends of the core, results in the pocket spring assembly thus formed having a stiffened periphery completely surrounding the core built of the first pocket spring webs. The longitudinal core ends or the longitudinal core edges are to be understood here in the context of the core-forming process, which takes place by attaching successive pocket springs webs side by side, parallel to each other. The first pocket springs web, to which the subsequent webs are subsequently attached, and the last one of the attached pocket springs webs provide the longitudinal core ends/longitudinal core edges, and the direction in which the core is built up by attaching the subsequent webs is referred to as the longitudinal direction.

Furthermore, in the method according to the invention described in WO2018/224139A1, providing the main core of the assembly comprises attaching a pair of non-woven layers to the upper and lower surfaces of the core of the pocket spring assembly so that the non-woven sheets cover said core and extend beyond the core transversely with respect to the longitudinal direction, ensuring that the attachment of at least one second web of pocket springs to the lateral surface of the core is carried out so that said at least one second web is placed between the pair of non-woven sheets. Furthermore, to achieve the attachment of the at least one web between the non-woven sheets, the method comprises holding the non-woven sheets by means of a clamping device and pushing said at least one second pocket springs web by means of a pusher between the non-woven sheets to the lateral surface of the core. The method also comprises compressing the springs of at least one second pocket springs web before attaching at least one second pocket spring to the core of the assembly, and allowing the compressed webs to relax when attached to the side surface of the core of the assembly. This step ensures that the second web adheres well to the non-woven sheets, as the adhesive is pressed against the upper and lower non-woven sheets due to the relaxation of the previously compressed springs.

The described solutions from the state of the art are quite complex in the context of manufacturing the described pocket spring assemblies. Furthermore, although the presented known solutions make it possible to ensure edge stability/stiffening, the implementation of the mentioned solutions in practice involves significant and costly modifications to already existing production lines, which are usually based on conventional spring assembly machines producing spring assemblies from continuous (so-called endless) pocket springs webs, in which all springs have the same or very similar elastic properties. The attachment of the stiffening spring webs to the longitudinal ends of the assembly can easily be done with the already mentioned conventional spring assembly machines, using technology that is well-known and has been used for years. To this end, one simply provides an additional source of stiffening spring web and ensures that it is attached in a manner analogous to the attachment of the first webs forming the core of the assembly. However, a complex technical problem is presented by providing a means of stiffening the assembly on the sides extending along the longitudinal direction of the core (i.e. in the direction of the attachment of the successive webs to form the core). The realization of such a method by attaching second stiffening web/second stiffening webs attached to the lateral plane of the core and running in its longitudinal direction requires the addition of a new step, necessitating the provision of additional equipment or significant modification of already existing machines in the production line.

The purpose of the present invention is therefore to provide a pocket spring assembly with a stiffened edge, suitable for use in the construction of a mattress, and which can be produced simply and cheaply and at the same time can provide better edge stability compared to solutions known from the state of the art.

This has been achieved by solutions according to the invention, as defined by independent claims. Advantageous embodiments of the invention are defined by the dependent claims.

The object of the invention is a pocket spring assembly comprising:

a plurality of first pocket springs webs, whereby adjacent first pocket springs webs are interconnected to form the core of the pocket spring assembly, a first textile layer and a second textile layer are attached respectively to the first and second surfaces of the core of the pocket spring, said textile layers extending along the entire area of said first and second surfaces of the core of the pocket spring assembly, at least one second pocket springs web is attached to the first lateral surface of said core of the pocket spring assembly to form a pocket spring assembly, said second pocket springs web extending perpendicularly to the direction of the first pocket springs webs, the springs in the first pocket springs webs having different stiffness characteristics from the springs in said at least one second pocket springs web, the pocket spring assembly according to the invention being characterized in that, that the first textile layer and the second textile layer do not extend beyond the area of said first and second surfaces of the core the pocket spring assembly, the pocket spring assembly further comprises a first textile strip which is attached to at least one second pocket spring web and to the first textile layer, and a second textile strip which is attached to at least one second pocket spring web and to the second textile layer.

In an advantageous embodiment of the invention, at least one and preferably two third pocket springs webs are positioned at one of the longitudinal ends of the core of the pocket spring assembly, the springs in said third pocket springs webs having different stiffness characteristics than the springs of the first pocket springs webs.

In another advantageous embodiment of the invention, the invention, at least one and more advantageously two third pocket springs webs are positioned at both longitudinal core ends of the pocket spring assembly, the springs in said third pocket springs webs having different stiffness characteristics than the springs of the first pocket springs webs.

In yet another advantageous embodiment of the invention, a set of two second pocket springs webs is attached to the first lateral surface of the pocket spring core, whereby a first textile strip and a second textile strip are attached to said set of two second pocket springs webs and to the first and second layers of the textile sheet.

In another advantageous embodiment of the invention, the pocket spring assembly comprises at least one second pocket springs web and advantageously a set of two second pocket springs webs attached to the second lateral surface of the core of the pocket spring assembly, the assembly comprising an additional first textile strip and an additional second textile strip, which are attached to at least one second pocket springs web, and preferably to a set of two second pocket springs webs attached to the second lateral surface of the core of the pocket spring assembly and to the first and second layers of textile material, respectively.

Also an object of the invention is a mattress comprising a pocket spring assembly, which comprises:

a plurality of first pocket springs webs, whereby adjacent first pocket springs webs are interconnected to form the core of the pocket spring assembly, a first textile layer and a second textile layer are attached respectively to the first and second surfaces of the core of the pocket spring, said textile layers extending along the entire area of said first and second surfaces of the core of the pocket spring assembly, at least one second pocket springs web is attached to the first lateral surface of said core of the pocket spring assembly to form a pocket spring assembly, said second pocket springs web extending perpendicularly to the direction of the first pocket springs webs, the springs in the first pocket springs webs having different stiffness characteristics from the springs in said at least one second pocket springs web, the pocket spring assembly according to the invention is characterized in that, the first textile layer and the second textile layer do not extend beyond the area of said first and second surfaces of the core the pocket spring assembly, the pocket spring assembly further comprises a first textile strip which is attached to at least one second pocket spring web and to the first textile layer, and a second textile strip which is attached to at least one second pocket spring web and to the second textile layer.

In an advantageous embodiment of a mattress according to the invention, in the pocket spring assembly at least one, and more preferably two third pocket spring webs are positioned at one of the longitudinal core ends of the pocket spring assembly, the springs in said third pocket spring webs having different stiffness characteristics than the springs of the first pocket spring bands.

In another advantageous embodiment of a mattress according to the invention, in the pocket spring assembly at least one, and more preferably two third, pocket springs webs are positioned at both longitudinal core ends of the pocket spring assembly, the springs in the third pocket springs webs having different stiffness characteristics than the springs of the first pocket springs webs.

In yet another advantageous embodiment of a mattress according to the invention, in the pocket spring assembly a set of two second pocket springs webs is attached to the first lateral surface of the pocket spring core, whereby a first textile strip and a second textile strip are attached to said set of two second pocket springs webs and to the first and second layers of the textile sheet.

In another advantageous embodiment of a mattress according to the invention, the pocket spring assembly comprises at least one second pocket springs web, and advantageously a set of two second pocket springs webs, attached to a second lateral surface of the core of the pocket spring assembly, whereby the assembly comprises an additional first textile strip and an additional second textile strip, which are attached to at least one second pocket springs web and preferably to a set of two second pocket springs webs attached to the second lateral surface of the core of the pocket spring assembly and to the first and second textile layers, respectively.

Also an object of the invention is a method of manufacturing a pocket spring assembly comprising the steps:

a) to provide a core of a pocket spring assembly, said core of the pocket spring assembly comprising a plurality of first pocket springs webs, the adjacent first pocket springs webs being interconnected to form said core of the pocket spring assembly, b) attaching a first layer of textile material and a second layer of textile material to respectively the first and second surfaces of said core of the pocket spring assembly, said layers of textile material extending along the whole area of said first and second surfaces of the core of the pocket spring assembly, the first layer of textile material and the second layer of textile material not extending beyond the area of said first and second surfaces of the core of the pocket spring assembly, c) providing at least one second pocket spring web in which the springs have a different spring rate characteristic than the springs in the first pocket spring sheet, wherein, according to the invention, the method is characterized in that it comprises the additional steps of:

d) attaching a first textile strip to the first textile layer along the longitudinal direction of the pocket springs core, so that a part of said first strip extends beyond the core of the pocket spring assembly, e) forming a pocket spring assembly by attaching said at least one second pocket spring web to the first lateral surface of the core of the pocket spring assembly and to the part of the first textile strip extending beyond the core of the pocket spring assembly, said at least one second pocket spring web extending perpendicularly to the direction of the first pocket spring bands, f) attaching the second textile strip to at least one second pocket spring web and to the second textile layer.

In an advantageous example of the implementation of the method according to the invention, step a) provides a core of the pocket spring assembly with at least one and preferably two third pocket spring webs attached to the outermost pocket spring web at the longitudinal end of the core of the pocket spring assembly, the springs in the third pocket spring web having different stiffness characteristics than the springs in the first pocket spring webs.

In another advantageous example of the implementation of the method according to the invention in step (a), a pocket spring assembly core is provided with at least one and preferably two third pocket spring webs attached to the outermost pocket spring webs at both longitudinal ends of the core of the pocket spring assembly, the springs in the third pocket spring web having different stiffness characteristics than the springs in the first pocket spring webs.

In yet another advantageous example of the implementation of the method according to the invention, in step d) the two first strips of textile material are attached to the first layer of textile material along the longitudinal direction of the pocket spring core, so that two parts of said first two strips project beyond the pocket spring core on both opposite sides thereof, and in step e) at least one second pocket spring web, and preferably a set of two second pocket spring webs, is additionally connected to the second lateral surface of the core of the pocket spring assembly, while in step f) the attachment of the second textile strips to at least one second pocket spring web and preferably a set of two second pocket spring webs and to the second layer of textile material is carried out on both opposite sides of the core of the pocket spring assembly.

The terms used in this description are to be understood in the manner accepted in the technical field of the invention, including the description of the state of the art presented above and the state of the art documents cited, unless the description clearly indicates otherwise.

Within the meaning of the invention, the pocket spring assembly comprises a core of the assembly and at least one second pocket springs web connected to the lateral surface of the core and extending in the longitudinal direction of the core, the core of the assembly being formed by a plurality of first pocket springs webs containing springs having different stiffness characteristics from the springs contained in said at least one second pocket springs web connected to the lateral surface of the core. Thus, there are at least two types of webs in the pocket spring assembly: the first webs, containing springs with a first stiffness characteristic, which, connected side to side, form the core of the pocket spring assembly. The longitudinal direction of the core is to be understood as the direction in which the successive webs forming the core are attached to each other, the longitudinal ends of the core being the outermost first webs from which the core of the pocket spring assembly is formed. The core of the pocket spring assembly may also according to the invention comprise at least one and more preferably two third pocket springs webs, which are positioned at both longitudinal ends of the core of the pocket spring assembly and attached to the outermost first webs, the springs in the third pocket springs webs having different stiffness characteristics than the springs of the first pocket springs webs.

Put together in the design of the pocket spring assembly according to the invention, the coil springs in the first, second and third pocket spring webs differ in their stiffness characteristics and are thus able to provide an assembly with a stiffened edge. It is known to the expert in the field that the stiffness characteristics of the helical springs can be adjusted accordingly, for example by using different spring diameters. Within the meaning of the invention, a helical spring has upper and lower coils and a plurality of central coils between the upper and lower coils, the largest of the diameters of the central coils of the spring being taken as the diameter of the spring within the meaning of the invention. It is known to the expert in the field that by using the same wire thickness, it is possible to achieve different spring stiffness (hardness) by selecting the coil diameter accordingly. Thus, assuming springs are made from the same diameter wire and are of the same spring height, a smaller diameter spring will be harder (stiffer) than a larger diameter spring. In addition, the spring's stiffness is influenced by the number of coils and the wire thickness, with the spring's stiffness increasing as the thickness of the wire from which the spring is made increases, while decreasing the number of coils increases the hardness.

The stiffness of the spring is also influenced by its primary height, understood as the height of the spring before it is placed in the pocket. As the primary height of the spring increases, its stiffness increases. With the above in mind, an expert in the field will easily realize a selection of springs with different stiffness characteristics by adjusting accordingly the above-mentioned parameters of spring construction, in particular the wire diameter, the original height and the diameter and number of spring coils. All parameter combinations known to the expert in the field that ensure different stiffness characteristics of the springs arranged in the first, second and third webs of the pocket spring assembly according to the invention are within the scope of the invention.

A textile material in the sense of the invention includes any textile material providing ability to join webs to form a mattress layer. Examples of such materials are non-woven fabrics, felts, woven fabrics.

The object of the invention is illustrated in more detail in the following description and in the drawing wherein.

All references in the figures showing different embodiments of the invention refer to identical elements of the pocketed springs assembly.

Figure 1:
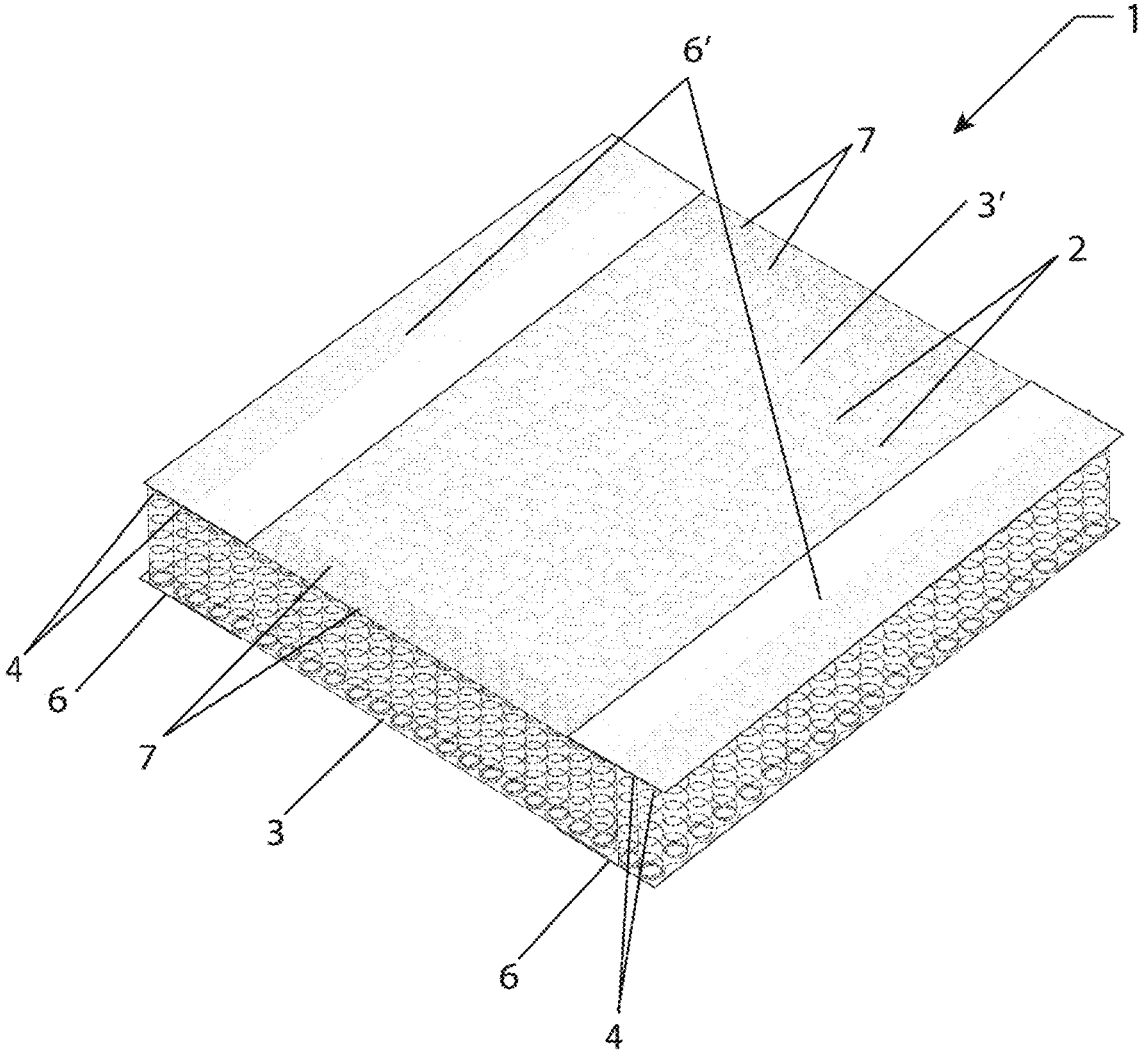
FIG. 1 shows in perspective view a pocket spring assembly in a preferred embodiment of the invention.

FIG. 1 shows, in an embodiment, a pocket spring assembly 1 which has a plurality of first pocket spring webs 2, a first layer 3 and a second layer 3' of textile material, second pocket spring webs 4, a first strip 6 of textile material and a second strip 6' of textile material, and third pocket spring webs 7.

Figure 2:
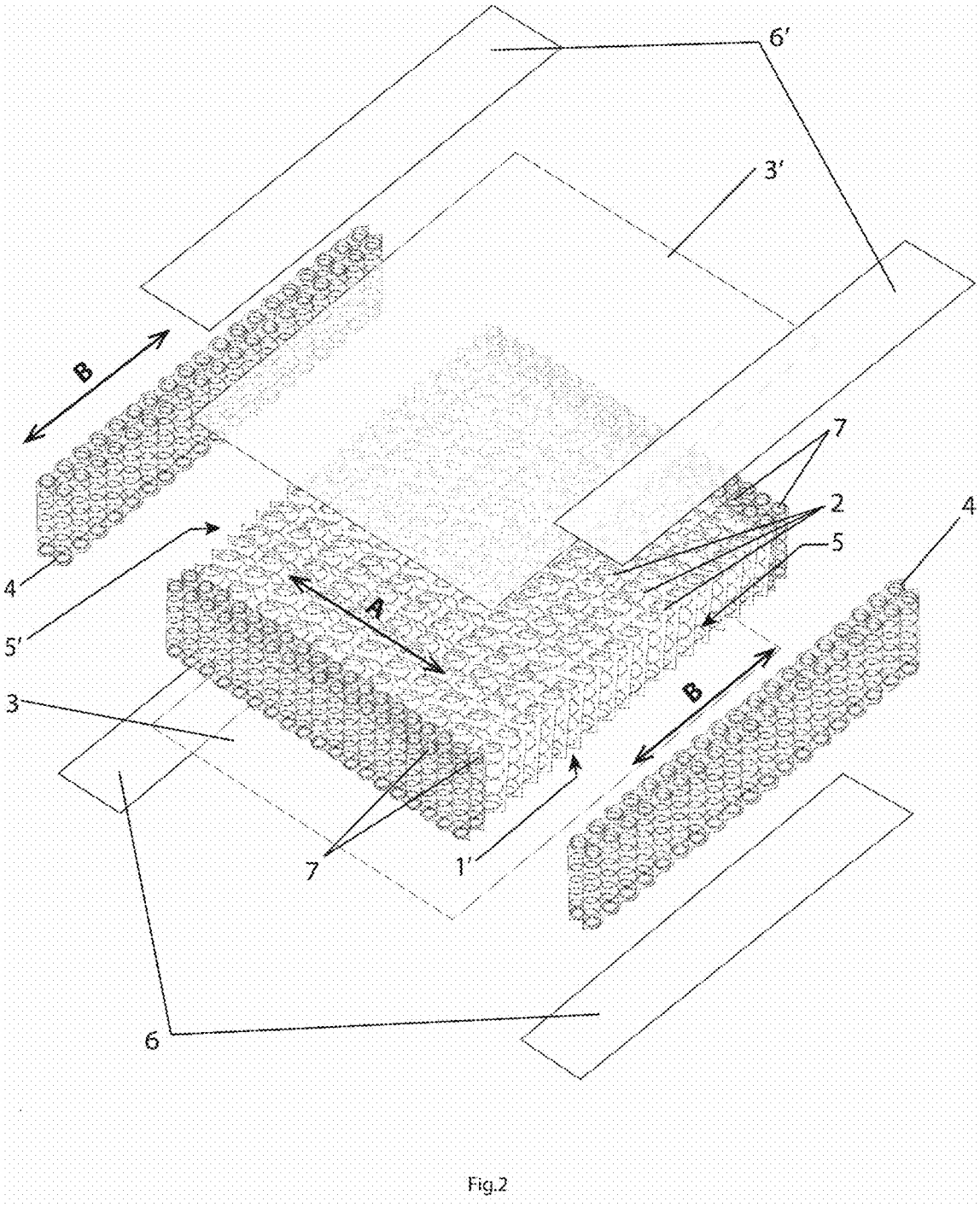
FIG. 2 shows in exploded view, in a preferred embodiment of the invention, a pocket spring assembly according to FIG. 1.

As it is better illustrated in the exploded view of FIG. 2, a plurality of first pocket spring webs 2 are adjacent one to another and are attached to each other along the direction in which they are arranged (the direction of the webs 2 (or web direction) is indicated in the drawing by an arrow as an A), The plurality of attached pocket spring webs 2 form the core 1' of the pocket spring assembly. FIG. 2 also shows a first layer 3 and a second layer 3' of textile material, second pocket spring webs 4 (joined together to form a set of two second pocket spring webs 4), a first strip 6 of textile material and a second strip 6' of textile material, and third pocket spring webs 7, all of which are schematically shown in view prior to being joined to form the pocket spring assembly. FIG. 2 also shows the lateral surfaces (5,5') to which the second webs 4 are attached so that they extend in the longitudinal direction B of the core 1', as indicated by the arrow in the drawing. As can be seen on the drawing, the longitudinal direction B (coinciding with the direction in which the second webs 4 of the pocket spring assembly 4 extend (in other words the direction of the webs)) is perpendicular to the direction A in which the first pocket springs webs 2 extend. The longitudinal direction B of the core 1' of the pocket spring assembly is the same direction in which the first pocket springs webs 2 are attached to each other to form the core 1'.

As also shown in FIG. 2, at both ends of the core 1' in the longitudinal direction B (hereinafter longitudinal ends of the core 1') arranged for connecting third pocket springs webs 7 to the first pocket springs webs 2, wherein the first webs 2 and the third webs 7 have the same web direction (direction A as indicated by an arrow). As shown in the drawing, the second webs 4 and third webs 7 of the pocket springs have a different spring geometry than that provided in the first pocket springs webs 2. The second webs 4 and third webs 7 differ in their stiffness characteristics from the first webs 2, providing stiffening of the edges of the spring assembly in the embodiment shown in the drawing.

Using FIGS. 3-9 as an example, an exemplary embodiment of the method steps according to the invention will now be presented.

Figure 3:
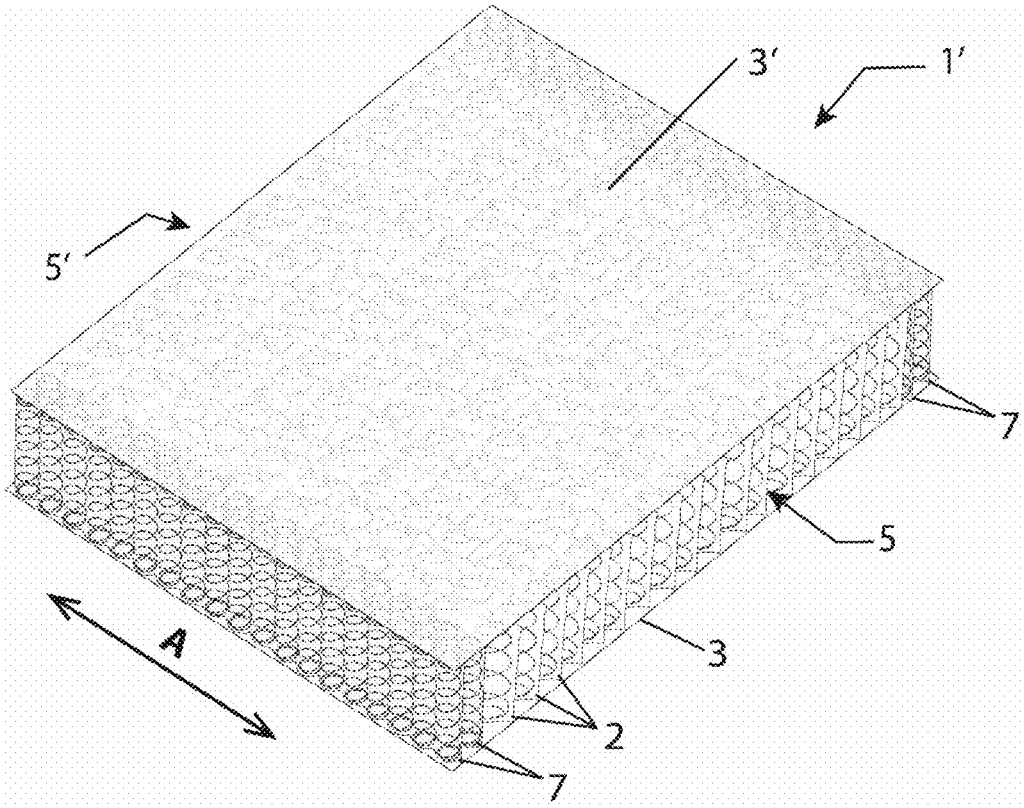
FIG. 3 shows in perspective view in a preferred embodiment of the invention the core of a pocket spring assembly with first and second textile layers placed on the first and second surfaces core of the core.

FIG. 3 shows a schematic representation of a core 1' of a pocket spring assembly provided in step a) of the method, wherein the core 1' of the pocket spring assembly comprises a plurality of first pocket spring webs 2, wherein adjacent first pocket spring webs 2 are connected to each other. The connection of the webs 2 can be realized, for example, by gluing them to each other along the direction A of their extension (as indicated by an arrow in the drawing). In this embodiment, the core is provided with third pocket spring webs 7 glued to the longitudinal ends of the core 1'. By differentiating the geometry of the springs contained in the pockets of the third pocket spring webs 7 with respect to the springs in the first webs 2, the longitudinal ends of the core 1' are stiffened.

As also shown in FIG. 3, a first layer 3 of textile material and a second layer 3' of textile material are attached (e.g. by gluing) to a first (here lower) and second (here upper) surface of the core 1', respectively, wherein, as shown in the drawing, both layers (3,3') of textile material extend along the entire area of said first and second surfaces of the core 1' of the pocket spring assembly and do not extend beyond the core 1'.

Figure 4:
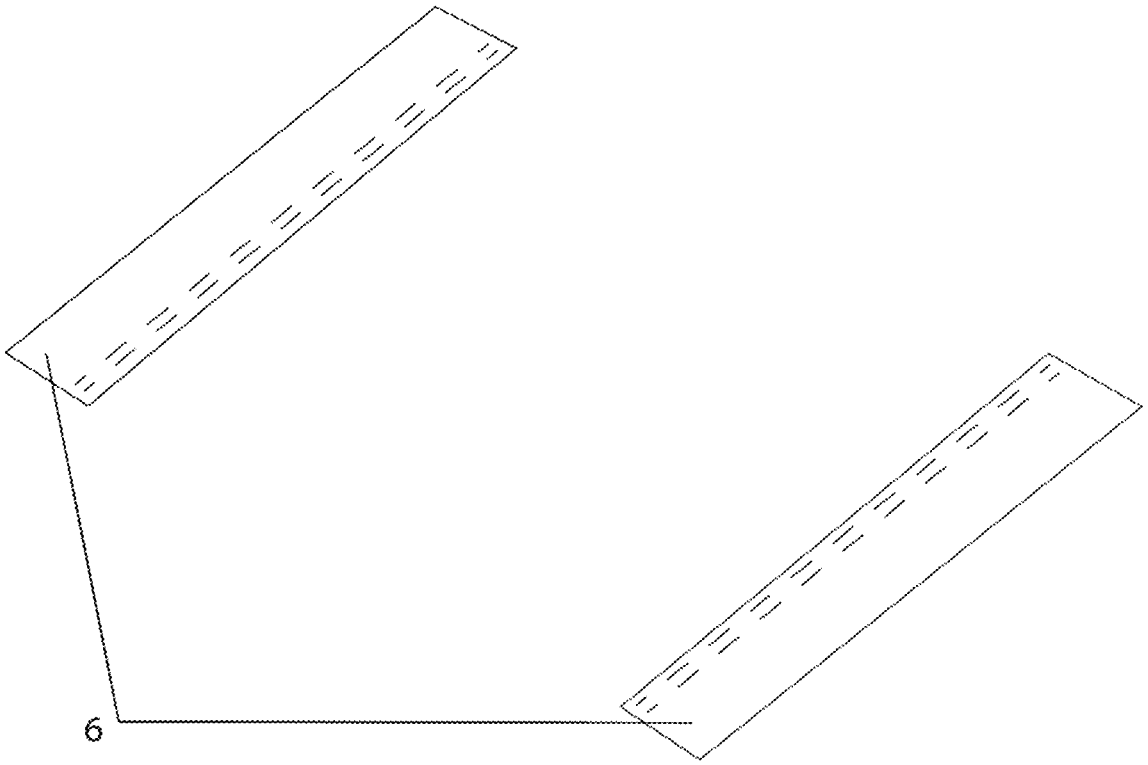
FIG. 4 shows, in a perspective view in preferred embodiment, the strips of a pocket spring assembly with the glue lines applied.
Figure 5:
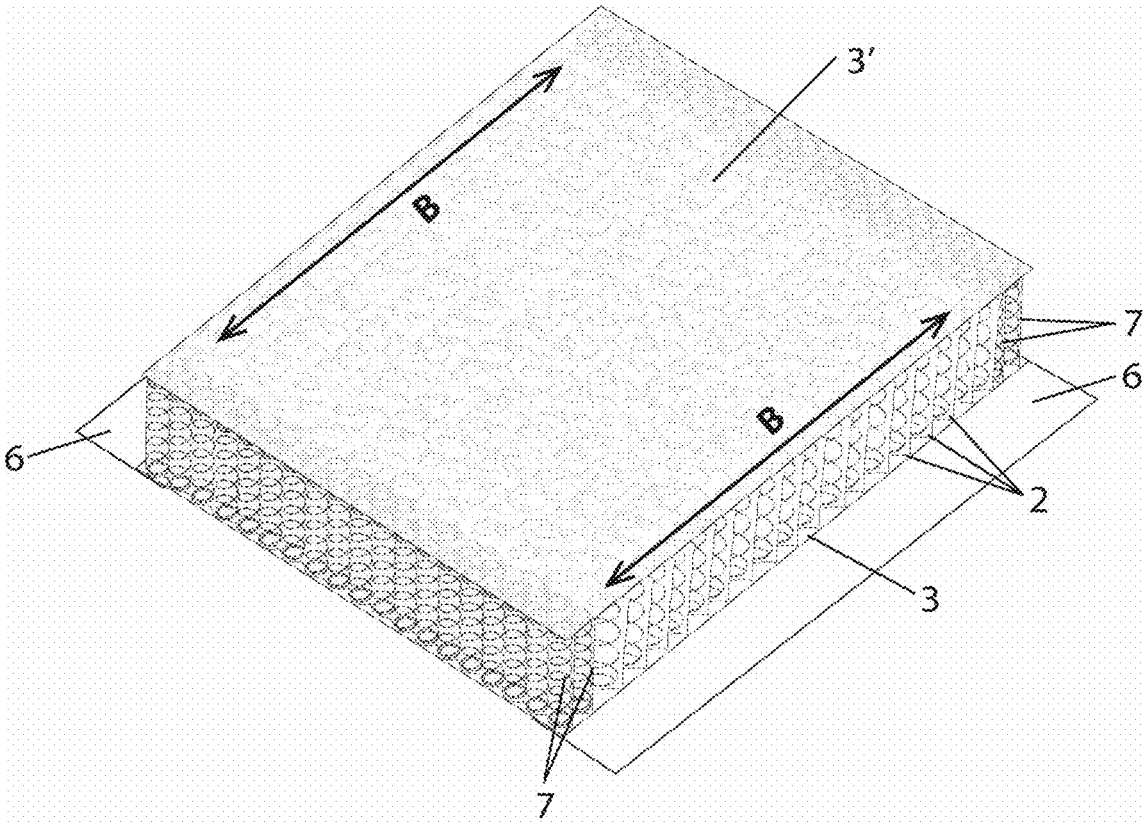
FIG. 5 shows, in a perspective view in preferred embodiment, a step of the process after the pocket spring assembly strips have been attached to one of the surfaces of the core.

FIG. 4 shows schematically first strips 6 with applied glue lines (marked with a dashed line) which enable the first strips 6 of textile material to be attached to the first layer 3 of textile material along the longitudinal direction B of the pocket springs core 1', as schematically shown in FIG. 5, wherein it is also shown that a part of said first strip 6 extends beyond the core of the pocket spring assembly.

Figure 6:
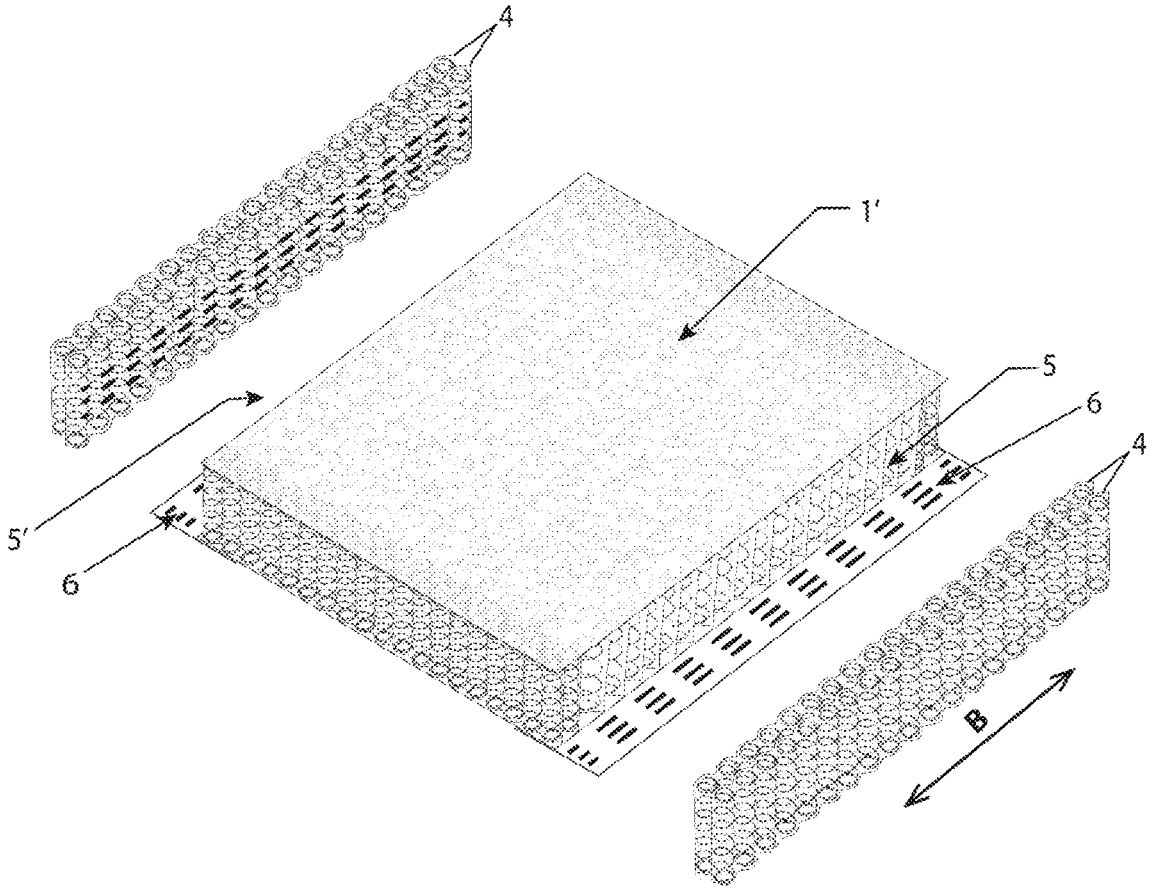
FIG. 6 shows, in a perspective view in preferred embodiment, a step of the method before attaching the first strips and the second pocket spring webs to the lateral surfaces of the core of the pocket spring assembly.

FIG. 6 schematically illustrates the step of creating the pocket spring assembly 1 before the second pocket spring webs 4 are attached to the core 1'. The drawing shows in dashed lines the application of glue lines to the parts of the first strips 6 extending beyond the core 1', which will allow the second pocket spring webs 4 to be attached to them. Glue lines are also applied to the side surfaces of the second pocket spring webs 4, which will be attached to the side surfaces 5,5' of the core 1' (due to perspective limitations, they are shown as dashed lines on one side only).

Figure 7:
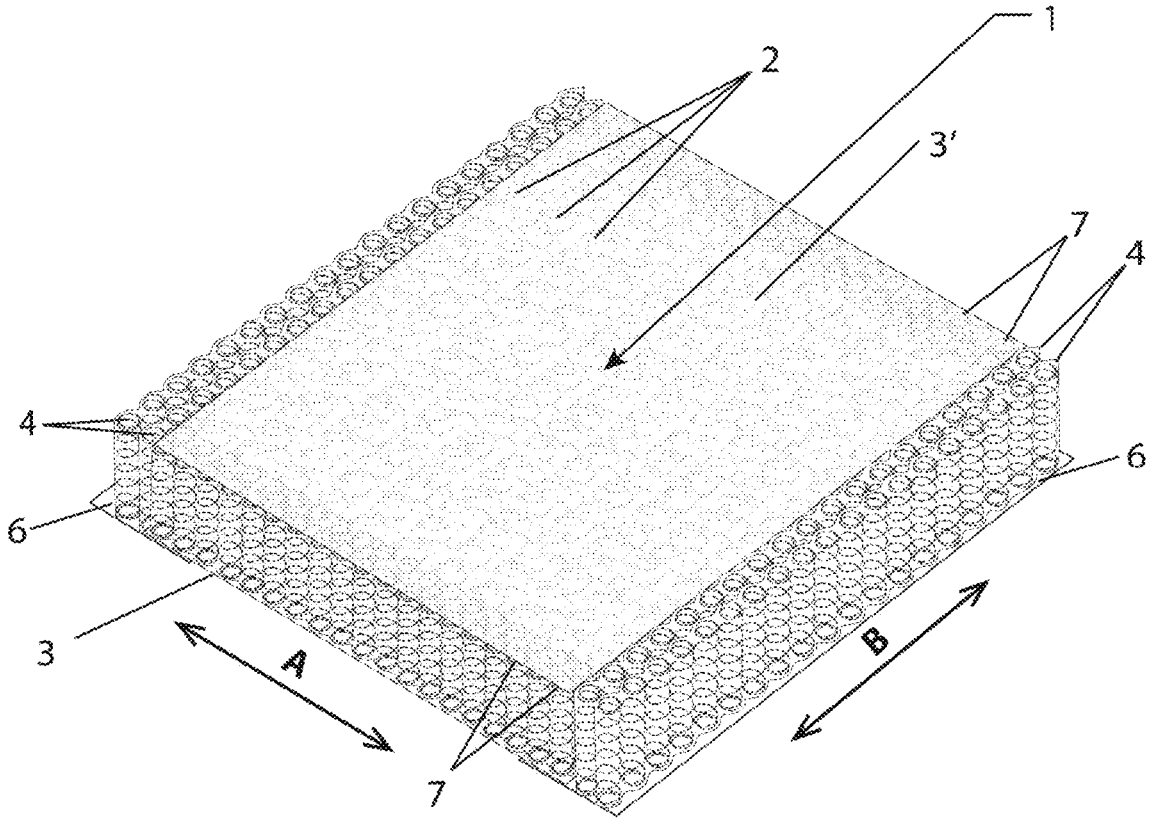
FIG. 7 shows, in a perspective view in preferred embodiment, a step of the method after the second pocket spring webs have been attached to the lateral surfaces of the core of the pocket spring assembly.

FIG. 7 shows a pocket spring assembly 1 formed by attaching second pocket spring webs 4 to the lateral surfaces of the core 1' of the pocket spring assembly (shown in FIG. 6) and to a portion of the first strip 6 of textile material extending beyond the core of the pocket spring assembly 1. As can be seen in the drawing, the second pocket spring webs 4 extend perpendicularly to the direction of the first and third pocket spring webs (2,7).

Figure 8:
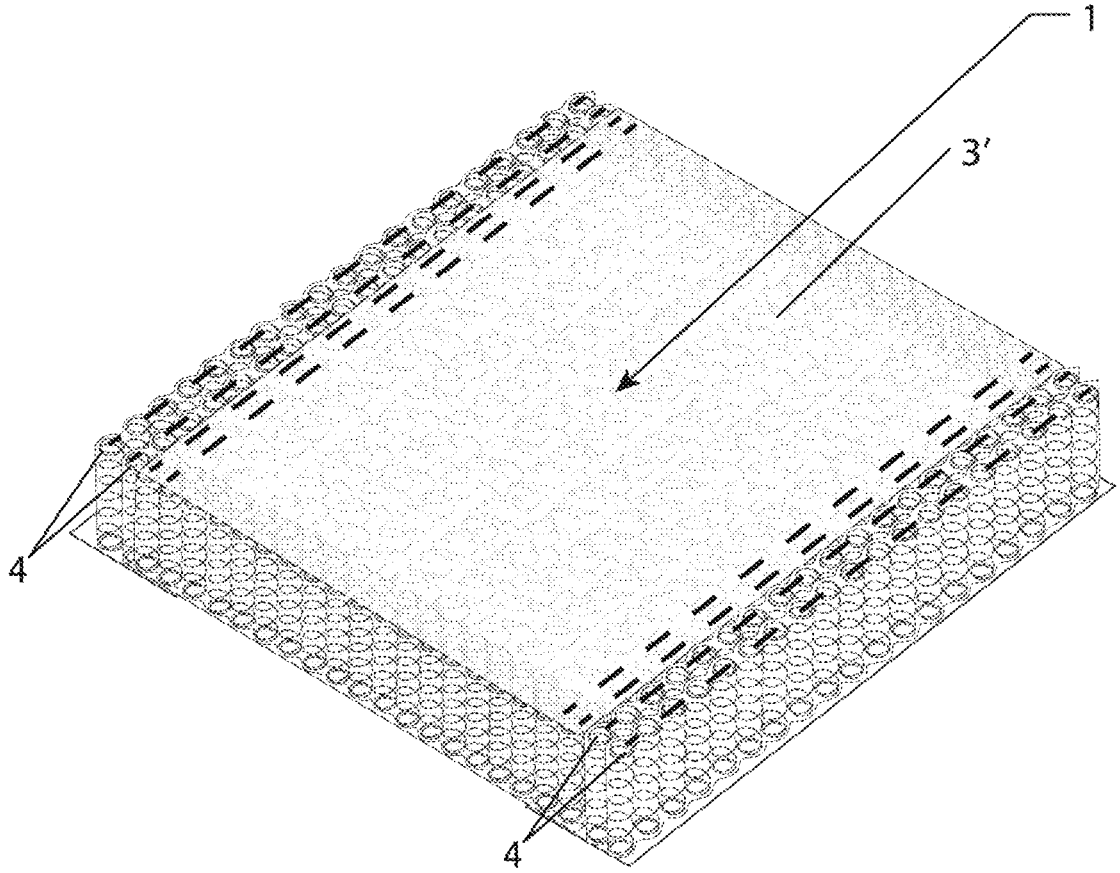
FIG. 8 shows in perspective view in preferred embodiment, a step of the process before the second strips are attached.
Figure 9:
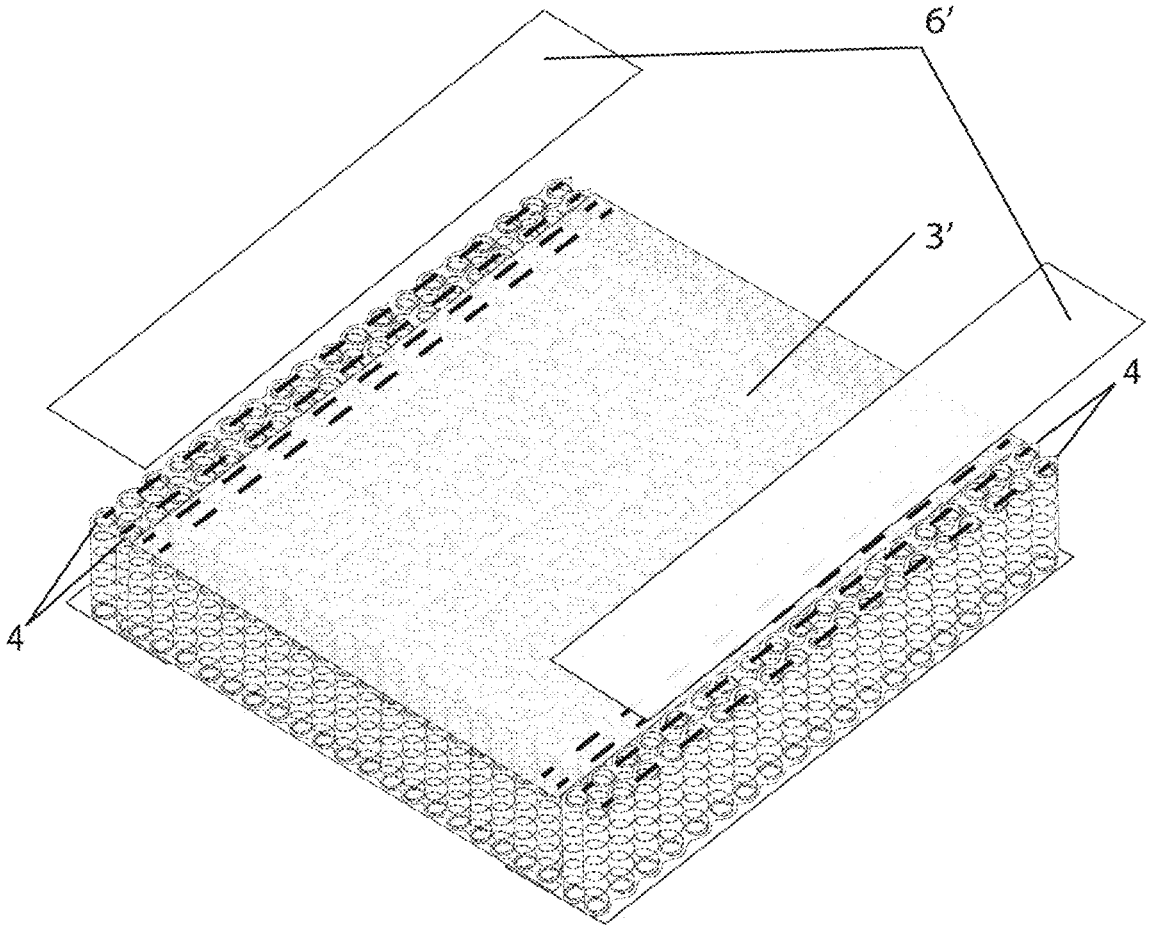
FIG. 9 shows, in a perspective view in preferred embodiment, the method of attaching the second strips.

FIG. 8 shows a step of the method prior to attaching the second strips 6' to the second pocket spring webs 4 and the second layer 3' of textile material, which are shown schematically in FIG. 9.

The solution according to the invention is an effective, simpler and cheaper alternative to reinforcing the edge of the pocket spring assembly compared to solutions known in the art. Attaching strips connecting at the same time the second pocket spring webs and the first and second layers of textile material not only provides effective reinforcement of the edge, but also significantly improves and stabilizes the shape of the corners, which become more filled and shapely. Depending on the configuration of the strips used and the geometry of the springs, the solution according to the invention allows for providing different comfort/stiffness zones in the middle and outer part of the mattress layer. Regardless of the above advantages, the production of the pocket spring assembly proposed by the invention can take place at reduced production costs compared to the production of the assemblies using known methods. In the embodiments shown in the drawing, a complete stiffening of the edge of the assembly is provided by ensuring that the second pocket spring webs are glued on both sides of the core, which is also equipped with stiffening resulting from placing third pocket spring webs on the longitudinal ends of the core. It is clear to the person skilled in the art, however, that the scope of the invention also includes solutions in which only partial stiffening of the edge is provided, for example by adding only one second pocket spring web without adding third webs. In the embodiment shown, adding second and third pocket spring webs in sets of two webs is arranged. It is clear to the person skilled in the art that stiffening of the edge, depending on the needs, can also be achieved by adding single second and third webs, or by adding sets comprising more than two second and third webs. Each such solution is covered by the content of the following claims.

The invention claimed is:

1. A pocket spring assembly comprising:

a plurality of first pocket spring webs, wherein adjacent first pocket spring webs are joined together to form a core of the pocket spring assembly, a first layer of textile material and a second layer of textile material attached to a first and second surface of the core of the pocket spring assembly, respectively, wherein the layers of textile material extend along an entire area of said first and second surfaces of the core of the pocket spring assembly, at least one second pocket spring web attached to a first lateral surface of said core of the pocket spring assembly, forming a pocket spring assembly, wherein said second pocket spring web extends perpendicularly to a direction of the first pocket spring webs, wherein springs in the first pocket spring webs have different stiffness characteristics than the springs in said at least one second pocket spring web, wherein:

the first layer of textile material and the second layer of textile material do not extend beyond the area of said first and second core surfaces of the pocket spring assembly, the pocket spring assembly further comprises:

a first strip of textile material directly attached to the first layer of textile material and having a portion extending laterally beyond the core of the pocket spring assembly which is directly attached to at least one second web of pocket springs, and a second strip of textile material directly attached to the second layer of textile material and having a portion extending laterally beyond the core of the pocket spring assembly which is directly attached to the at least one second web of pocket springs, wherein the portion of the first strip of textile material and second strip of textile material extending laterally beyond the core of the pocket spring assembly has a width substantially equal to a width of the at least one second web of pocket springs.

2. The pocket spring assembly according to claim 1, wherein the core comprises longitudinal ends, and wherein one or more third pocket spring webs are disposed at one of the longitudinal ends of the core of the pocket spring assembly, springs in the third pocket spring webs having different stiffness characteristics than the springs in the first pocket spring webs.

3. The pocket spring assembly according to claim 1, wherein the core comprises opposed longitudinal ends, and wherein one or more third pocket spring webs are disposed at both longitudinal ends of the core of the pocket spring assembly, springs in the third pocket spring webs having different stiffness characteristics than the springs of the first pocket spring webs.

4. The pocket spring assembly according to claim 1, wherein a set of two second pocket spring webs are attached to a first side surface of the pocket spring core, the first strip of textile material and the second strip of textile material being directly attached to said set of two second pocket spring webs and to the first and second layers of textile material.

5. The pocket spring assembly according to claim 1, wherein the pocket spring assembly comprises one or more second pocket spring webs, attached to a second lateral surface, opposite the first lateral surface, of the core of the pocket spring assembly, the assembly comprising an additional first strip of textile material and an additional second strip of textile material, which are directly attached to one or more second pocket spring webs attached to the second lateral surface of the core of the pocket spring assembly, and to the first and second sheets of textile material, respectively.

6. A mattress comprising a pocket spring assembly according to claim 1.

7. A method of manufacturing a pocket spring assembly comprising the steps of:

a) providing a core of the pocket spring assembly, said core of the pocket spring assembly comprising a plurality of first pocket spring webs, wherein adjacent first pocket spring webs are joined together to form said core of the pocket spring assembly, b) attaching a first layer of textile material and a second layer of textile material to first and second surfaces of said core of the pocket spring assembly, respectively, said layers of textile material extending along an entire area of said first and second surfaces of the core of the pocket spring assembly, wherein the first layer of textile material and the second layer of textile material do not extend beyond the area of said first and second surfaces of the core of the pocket spring assembly, c) providing at least one second pocket spring web in which springs have different stiffness characteristics than springs in the first pocket spring webs, d) attaching a first strip of textile material directly to a first layer of textile material along a longitudinal direction of the core of the pocket springs, such that a portion of said first strip extends beyond the core of the pocket spring assembly, e) forming the pocket spring assembly by attaching said at least one second web of pocket springs to a first lateral surface of the core of the pocket spring assembly and directly to a portion of the first strip of textile material extending beyond the core of the pocket spring assembly, the portion of the first strip of textile material extending beyond the core of the pocket spring assembly has a width substantially equal to a width of the at least one second web of pocket springs, said at least one second web of pocket springs extending perpendicularly to a direction of extension of the first webs of pocket springs, f) attaching a second strip of textile material directly to at least one second web of pocket springs and directly to the second layer of textile material.

8. The method according to claim 7, wherein in step a) a pocket spring assembly core is provided with one or more third pocket spring webs attached to an extreme pocket spring web at a longitudinal end of the core of the pocket spring assembly, springs in the third pocket spring web having different stiffness characteristics than the springs in the first pocket spring webs.

9. The method according to claim 7, wherein in step a) a pocket spring assembly core is provided with one or more third pocket spring webs attached to the outermost pocket spring webs at both longitudinal ends of the core of pocket spring assembly, springs in the third pocket spring web having different stiffness characteristics than the springs in the first pocket spring webs.

10. The method according to claim 7, wherein in step d) two first strips of textile material are attached to the first layer of textile material so that two parts of said two first strips extend beyond the core of the pocket springs on both opposite sides thereof, and in step e) one or more second webs of pocket springs, are additionally attached to the second lateral surface of the core of the pocket spring assembly, and in step f) direct attachment of second strips of textile material to one or more second webs of pocket springs, and to the second layer of textile material takes place on both opposite sides of the core of the pocket spring assembly.

* * * * *